US009051672B2

(12) United States Patent
Bearden

(10) Patent No.: US 9,051,672 B2
(45) Date of Patent: Jun. 9, 2015

(54) TUFTING MACHINE FOR PRODUCING A PRECISE GRAPHIC DESIGN

(76) Inventor: John H. Bearden, Woodstock, GA (US)

( * ) Notice: Subject to any disclaimer, the term of this patent is extended or adjusted under 35 U.S.C. 154(b) by 824 days.

(21) Appl. No.: 13/330,671

(22) Filed: Dec. 19, 2011

(65) Prior Publication Data

US 2012/0152159 A1 Jun. 21, 2012

Related U.S. Application Data

(60) Provisional application No. 61/424,176, filed on Dec. 17, 2010.

(51) Int. Cl.
*D05C 15/30* (2006.01)

(52) U.S. Cl.
CPC ..... *D05C 15/30* (2013.01)

(58) Field of Classification Search
CPC ..... D05C 15/30; D05C 15/26
USPC ..... 112/80.01, 80.3, 80.33, 80.32, 80.31, 112/475.23, 80.43
See application file for complete search history.

(56) References Cited

U.S. PATENT DOCUMENTS 3,059,598 A * 10/1962 Wade ..... 112/80.3
3,865,059 A * 2/1975 Jackson ..... 112/80.32
3,881,432 A * 5/1975 Dodd et al. ..... 112/80.33
4,173,192 A * 11/1979 Schmidt et al. ..... 112/80.24
4,254,718 A * 3/1981 Spanel et al. ..... 112/80.07
4,432,296 A * 2/1984 Grondin ..... 112/475.23
4,790,252 A * 12/1988 Bardsley ..... 112/80.4
4,815,402 A * 3/1989 Price ..... 112/80.44
4,829,917 A * 5/1989 Morgante et al. ..... 112/80.41
4,831,948 A * 5/1989 Itoh et al. ..... 112/80.43
4,883,009 A * 11/1989 Haselberger et al. .... 112/475.18
5,040,473 A * 8/1991 Zesch et al. ..... 112/117
5,058,518 A * 10/1991 Card et al. ..... 112/80.23
5,143,003 A * 9/1992 Dedmon ..... 112/80.43
5,224,434 A * 7/1993 Card et al. ..... 112/80.41
5,461,996 A * 10/1995 Kaju ..... 112/80.3
5,544,605 A * 8/1996 Frost ..... 112/475.23
5,549,064 A * 8/1996 Padgett, III ..... 112/410
5,743,200 A * 4/1998 Miller et al. ..... 112/80.01
5,979,344 A * 11/1999 Christman, Jr. ..... 112/80.23
6,263,811 B1 * 7/2001 Crossley ..... 112/80.4
6,807,917 B1 * 10/2004 Christman et al. ..... 112/80.23
7,216,598 B1 * 5/2007 Christman, Jr. ..... 112/475.23
7,347,151 B1 * 3/2008 Johnston et al. ..... 112/80.01
7,426,895 B2 * 9/2008 Smith et al. ..... 112/80.32
7,490,566 B2 * 2/2009 Hall ..... 112/80.4
7,717,051 B1 * 5/2010 Hall et al. ..... 112/475.05
7,814,850 B2 * 10/2010 Bearden ..... 112/80.4
7,946,233 B2 * 5/2011 Hall et al. ..... 112/80.54
8,096,247 B2 * 1/2012 Monroe et al. ..... 112/80.43
8,141,505 B2 * 3/2012 Hall et al. ..... 112/80.41

(Continued)

*Primary Examiner* — Danny Worrell
(74) *Attorney, Agent, or Firm* — Invention Protection Associates, LLC

(57) ABSTRACT

A tufting machine producing athletic turf bearing precise graphic patterns at a high throughput rate is disclosed. The machine includes tenter frame to which a backing material is attached, a bed frame to which the tenter frame is attached, a support assembly upon which the bed frame is movably mounted, and a series of tufting frames upon which tufting head components are mounted. The tenter frame and bed frame are computer-controlled to advance and retract the backing relative to the tufting frames, and the tufting head components are computer controlled to laterally shift and to asynchronously reciprocate tufting needles as is necessary to form a desired tuft pattern.

10 Claims, 11 Drawing Sheets

(56) References Cited

U.S. PATENT DOCUMENTS 8,347,800 B1 * 1/2013 Machell-Archer et al. ..... 112/475.23
8,359,989 B2 * 1/2013 Hall et al. ..... 112/80.23
8,443,743 B2 * 5/2013 Christman, Jr. ..... 112/80.23
2012/0222606 A1 * 9/2012 Bearden ..... 112/475.23

* cited by examiner

TUFTING MACHINE FOR PRODUCING A PRECISE GRAPHIC DESIGN

This non-provisional application claims the benefit of provisional application No. 61/424,176 filed Dec. 17, 2010.

BACKGROUND

Conventional broadloom tufting machines designed for manufacturing carpet and artificial athletic turf in high volume are primarily characterized by having cooperating backing feed and tufting head assemblies. Typically, such a backing feed assembly is defined by an arrangement of feed and take-up rollers that convey an elongate sheet of backing fabric through a tufting zone area in which yarn is inserted into the steppedly advancing backing. Differential rotation between feed assembly rollers stationed at opposing ends of the tufting zone creates longitudinal tension in the backing.

The tufting head portion of the broadloom machine generally features one or more elongate bars of yarn-delivering needles which are disposed above the horizontal backing and aligned transverse to the direction of its movement, as well as an equivalent number of yarn-catching loopers that are disposed below the backing. Needles along the needle bar(s) each receive yarn, delivered by any of a variety of suitable yarn feed mechanisms, from a designated spool situated within a yarn creel. So, as the backing sheet travels past the tufting head, needle bars are continually reciprocated downward so that the needles along them penetrate and insert yarn into the backing in unison. The loopers operate in synchronicity with the needles such that, as each needle momentarily protrudes the backing, a corresponding looper catches its yarn before the needle returns upward. This repeated interaction produces "loop pile" tufts of yarn along the backing. Additionally, knives can be used to sever just-formed loops and thereby render "cut pile" tufts.

Where uniformly patterned carpet or vast monochrome sections of athletic turf are to be produced in high volume, a broadloom tufting machine's needle can span the entire transverse width of the backing material. The incremental, longitudinal progression of the backing material that immediately follows each stroke of the needle bar causes the laterally-aligned needles to form every longitudinal running row of tufts intended to be created across the lateral length of the backing sheet. Thus, the tufting needles stationed along the needle bar remain at constant lateral positions, and there is no need for them to be transversely shifted when creating carpet or turf sections having uniform tuft placement and yarn color. On the other hand, tufting machines exhibiting constant axis needle bar movement are generally not suitable for producing multicolored articles of tufted material. So, the prior art has seen tufting machines improved to enable their needle bars to shift laterally, relative to the backing, in order that the particular type of yarn delivered by particular individual needles be selectively inserted into the backing at specific tuft locations in accordance with a preconceived pattern. For example, U.S. Pat. No. 4,829,917 to Morgante, et al. discloses the use of a computer-controlled hydraulic actuator for shifting a needle bar into different lateral positions in response to preselected stitch pattern information stored in the computer. As another example, U.S. Pat. No. 5,979,344 to Christman, Jr. discloses the use of computer-controlled inverse roller screw actuators for shifting needle bars laterally, as well as for shifting the backing sheet itself laterally, in order to tuft a graphic pattern of yarn into the backing as it advances longitudinally past transversely aligned needles.

Nevertheless, even with the lateral shiftability of their tufting heads, these prior tufting machines that employ backing feed mechanisms are still not optimum for producing precise, dynamic, multicolored tuft patterns like those often found in artistic logo-bearing sections of artificial athletic turf. That is, firstly, because the synchronous reciprocation of their bar-mounted needles produces linear color patterns, and even lateral shifting of the needle bars can no more than produce diagonal or zigzagging patterns. In addition, since conventional tufting machines with backing feed mechanisms experience many subtle operational irregularities in the cooperative motions of their tufting head and backing feed components, the tuft patterns that they create tend to be imprecise.

More specifically, tufting needles of prior art backing fed tufting machines reciprocate (along Z-axes) and may shift (along an X-axis) in timed relationship with the stepped longitudinal progression (along a Y-axis) of the backing fabric being fed past those needles. Whenever that three-axis motion relationship is altered in an unplanned way, the tufting needles fail to insert yarn tufts precisely at intended positions. For example, any sudden lag or surge in the feed mechanism's operation can create irregularity in the longitudinal spacing between successive tufts within rows, and any lateral skewing of the backing sheet can displace tuft rows entirely. The result of either occurrence may be noticeable distortion of the overall graphic image being created.

Moreover, inherent characteristics of backing material itself tends to undermine the quality of graphic output of these prior art machines. To wit, because backing sheets are typically fabricated of coarsely woven material, they are susceptible to being non-uniformly stretched, in either direction, as feed rollers advance them through the tufting zone. Since athletic field logos are almost always too large to be entirely formed within the lateral boundaries of a machine's tufting zone—which is typically no more than 15 feet wide they must be created in pieces by individually tufting separate sheets of backing material and then gluing those sheets, side-by-side, onto a base layer material. This leaves open the possibility that one image-bearing section of backing will progress through the tufting zone differently, in some respect, than does an adjacently laid section and will, in turn, manifest as color discontinuity within the composite image that is visible upon installation. Therefore, in the process of tufting separate graphically patterned artificial turf pieces for a single installation, there is a premium on being able to ensure that tension applied to backing material remains consistent and that no unwanted lateral movement occurs within the tufting zone.

Tufting head assemblies that operate while moving two-directionally relative to statically held backing sheets have been developed in the prior art to address these stability concerns related to production of detailed tuft patterns. For example, U.S. Pat. No. 5,743,200 to Miller, et al. discloses a tufting machine that employs a gantry-like component which is movable along a Y-axis and which carries a tufting head that is movable along an X-axis. The Miller tufting head is disposed above the backing material, and it is mounted to the gantry via its attachment to a frame which is gearably connected to and movable along the gantry. The tufting head generally comprises a cylinder that is slidably secured to the frame, a piston that reciprocates within the cylinder, a needle that is secured to the bottom end of the cylinder and a blade that is positioned within the needle and is secured to the bottom of the piston. The blade projects from and retracts into the needle to assist the needle in protruding down through the backing to form loop pile tufts therein. The Miller tufting machine also includes a second, lower gantry that spans transversely below the backing material and moves along a Y-axis in synchronicity with the upper gantry. This lower gantry provides underlying support for the backing material in order to limit the downward deflection that would otherwise result from the pressure applied by the blade and needle operating on the backing.

Another example is found in U.S. Pat. No. 7,814,850 to the present inventor. That patent discloses a tufting machine with a dual-beam gantry configuration and that includes a computer-controlled tufting head adapted to move along X and Y axes in order to insert various yarns at precise locations along a clamped down and statically held backing in accordance with a design pattern stored in the computer. It also discloses a tufting head for producing precise graphic tuft patterns that is defined by having two distinct and asynchronously driven parts: (a) a needle carriage that is movably mounted along the upper gantry beam (i.e., above the backing) and features a number of separately operating tufting needles that are selectively reciprocated to insert tufts as the carriage journeys along an X-axis; and (b) a looper carriage that is movably mounted to the lower beam (i.e., below the backing) and is not mechanically connected to the needle carriage, but rather is selectively advanced to and fro along that beam in non-unison with the needle carriage such that a single looper and cutter pair may selectively cooperate with each one of multiple carriage needles as they individually downstroke.

Nevertheless, while these fixed backing type tufting machine configurations allow for proper tensioning and stabilization of backing pieces to be practiced repeatedly, they do not lend themselves to high production throughput. In fact, the exercise of manually removing and replacing backing sheets for successive tufting, alone, makes these kinds of machines impractical for creating anything other than a relatively small section of an athletic field bearing a graphic design. Consequently, the larger "green areas" of turf are typically produced entirely separate from the design areas by feeding separate rolls of backing material through conventional broadloom machines. In some instances, this phenomenon has led to athletic field turf manufacturers having to invest in more machinery in order to be able to produce all of the tufted backing strips needed for an entire field installation. In other instances, it has led to turf purchasers ordering tufted parts of a single field installation from separate manufacturing vendors: one specializing in high throughput production of the larger green sections and another specializing in production of smaller graphic image sections. Furthermore, regardless of whom does the manufacturing, installers are burdened with having to carefully piece potentially numerous backing pieces together at abuse surface, rather than unrolling onto a base a relative few field long rolls of backing.

Accordingly, the present invention a longstanding need for a tufting machine configured to produce continuous, lengthy sections of graphic and non-graphic athletic turf under conditions of backing stability achieved by previous fixed backing machines, but at a throughput rate more approaching that achieved by previous machines utilizing less stable backing feed assemblies. The tufting machine of the present invention substantially fulfills this need.

SUMMARY

The present invention generally relates to tufting machines, and it specifically relates to a tufting machine principally intended for use in manufacturing fields of artificial athletic turf. In fact, one primary objective of the invention is to provide a tufting apparatus adapted to simultaneously and/or without any manual intervention produce, from a single roll sheet of backing material, both the precise, multicolored graphic image portions of an athletic field as well as the more uniformly colored portions. Another primary objective is to perform graphic image tufting at a throughput rate approaching that achieved by prior art broadloom tufting machines which are not suitable for creating detailed image patterns.

In one aspect, the present invention neither uses powered rollers to drive backing material through its tufting zone in a potentially laterally unstable manner, nor does it require a backing sheet to be clamped down so that it is fixedly held in uniform tension while being operated upon. Rather, the present apparatus includes a tenter frame defined by a pair of generally parallel, looped tenter chains that engage the lateral near edges of a backing and advance it through the tufting zone with complete lateral stability and appropriate lateral tension. The tenter frame can be further defined by having a portion extending before the tufting zone in which the tenter chains are slightly divergent so that they laterally stretch a backing to a desired tension level immediately prior to it being tufted.

In another aspect, the present tufting apparatus may also feature a spooling roller stationed just beyond the distal end of its tufting zone that is powered to rotate in synchronicity with rotation of the tenter chains and thereby gather up tufted segments of a continuous backing sheet as they exit the zone. The tenter assembly and spooling roller combination enable a continuously long sheet of backing material to be tufted under lateral and longitudinal tension and then immediately wound into a roll suitable for transport to an installation site.

In another aspect, the apparatus features multiple, dual beam tufting gantries that are fixed at equally spaced positions along the length of its tufting zone. Laterally spaced along each gantry's upper beam are laterally shiftable and individually reciprocating tufting needles, and a corresponding set of laterally shiftable loopers are mounted along its lower beam. Although, within the scope of the invention, the exact number of tufting gantries employed can vary, that count may be directly correlated to the number of different colored yarns to be tufted. For example, each colored yarn can be assigned to its own gantry and delivered to all of the needles along that gantry that will be utilized at some point during a tufting job.

In fact, in yet another important aspect of the invention, the tenter frame is fixedly mounted to a bed frame that is, itself, mounted atop a guide track and roller support assembly which enables the bed frame and backing to be slid back and forth longitudinally relative to the stationary tufting gantries without imparting rotation to the tenter chains. Thus, the present apparatus holds a backing material in taut condition while its tenter assembly selectively moves the backing forward and rearward throughout a tufting zone by way of both (a) itself traveling forward and rearward while remaining in fixed relation to an engaged backing segment; and (b) conveying forward the segment so that subsegments of it can be appropriately tufted by successive tufting heads. Consequently, if, for example, a single yarn color is delivered to all needles along each gantry and every gantry receives a different yarn, reverse movement of the bed frame followed by lateral shifting of the needles allows the machine to successively create parallel tuft rows of whatever colors and tuft gauge is desired.

This all facilitates efficient and precise creation of dynamic, multi-colored tufted designs along a continuous sheet of backing material.

DESCRIPTION OF A PREFERRED EMBODIMENT

It should be understood that the present disclosure has particular applicability to machines used for manufacturing athletic turf and other cut pile articles bearing graphic designs, but it can be applicable to tufting machines generally. This disclosure, as embodied in FIGS. 1-5, relates to a tufting apparatus that can be viewed as generally comprising three primary structural elements: a bed frame 1, a tenter frame 5 and at least one tufting frame 2. Then, attached to or as sub-elements of those primary structural elements are a tufting head which, itself, comprises a needle carriage assembly 20 and looper carriage assembly (not shown). Additionally, a computer (not shown) is used to control all of the selective motions imparted by various drive components of the tufting apparatus throughout its operation.

Figure 4:
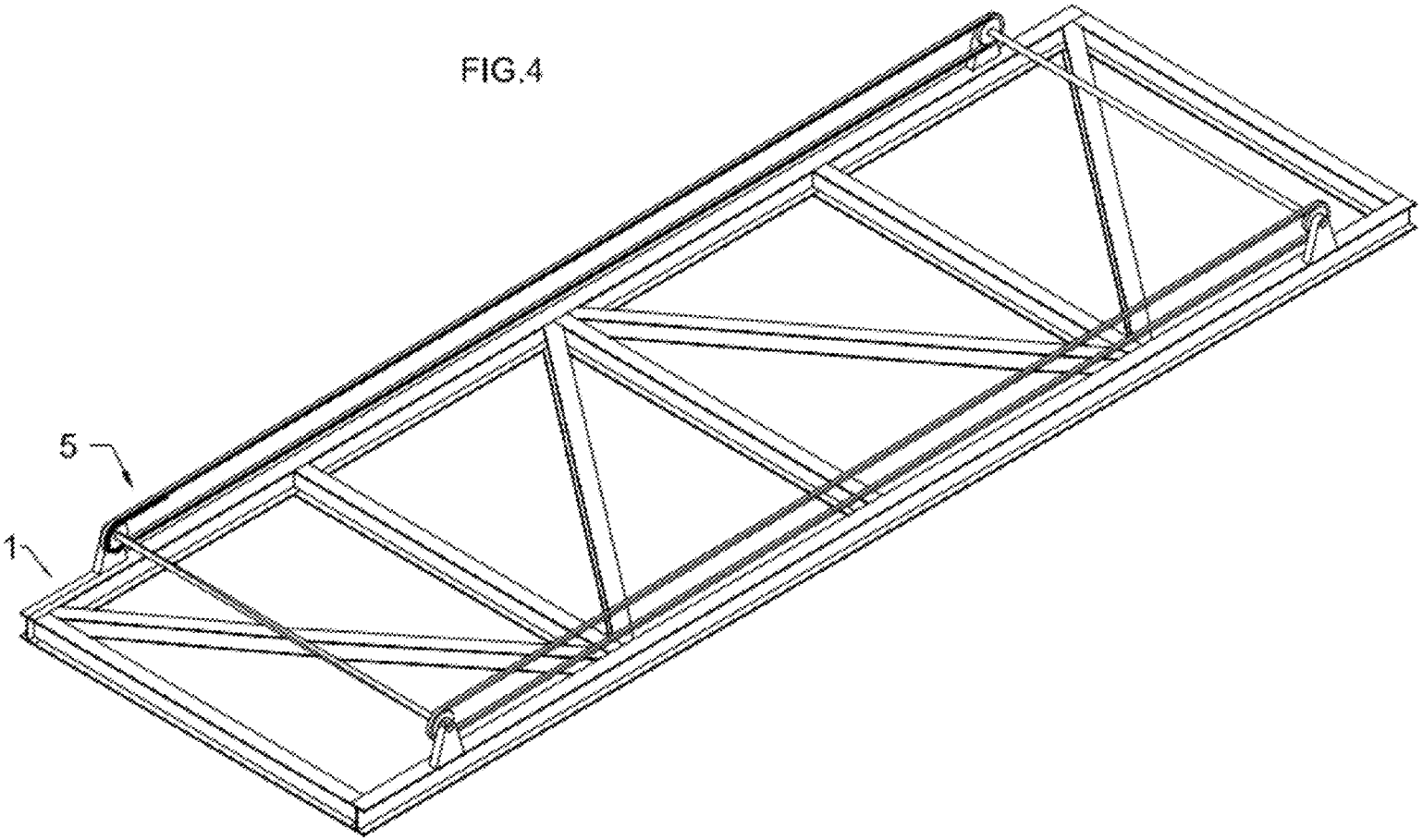
FIG. 4 is a perspective view of the bed frame and tenter frame elements of said machine.
Figure 5:
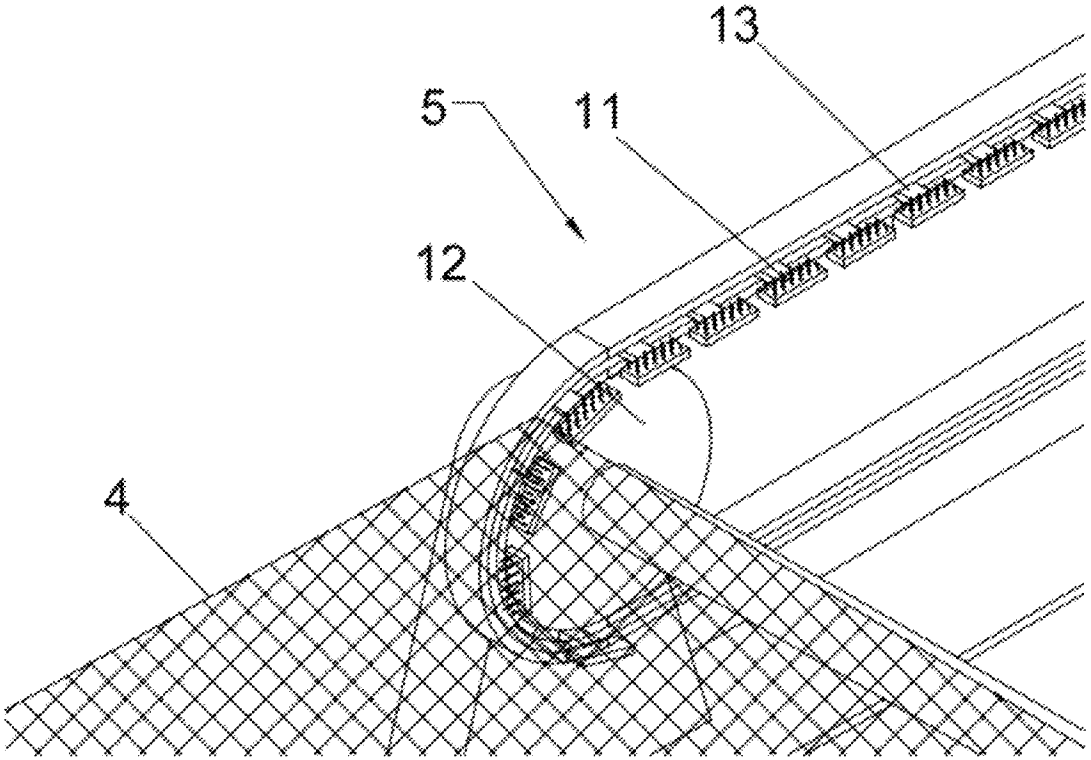
FIG. 5 is a perspective view showing an end portion of said tenter frame.
Figure 6:
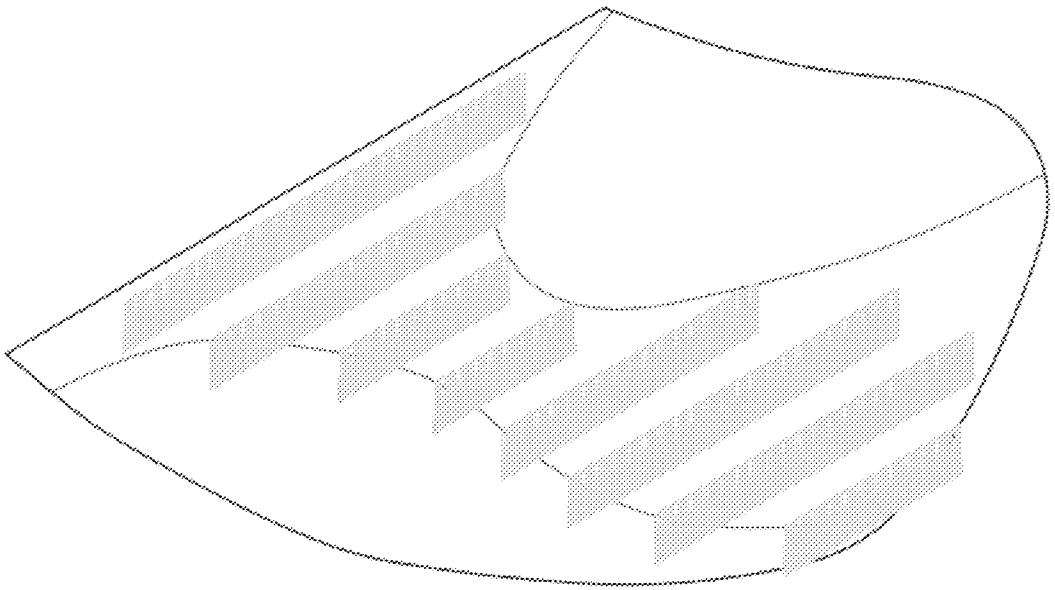
FIG. 6 is a perspective view showing a segment of backing material after having undergone one tufting pass of the first tufting frame it encounters which tufts that segment.
Figure 7:
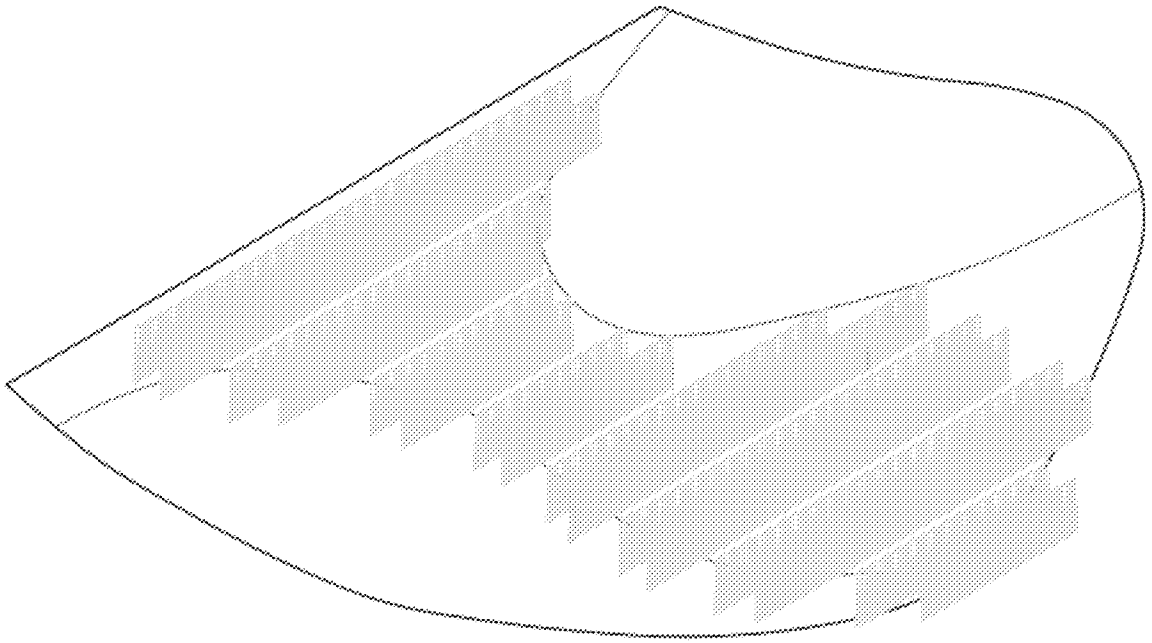
FIG. 7 is a perspective view showing said backing segment after having undergone two tufting passes of the first tufting frame it encounters which tufts that segment.
Figure 8:
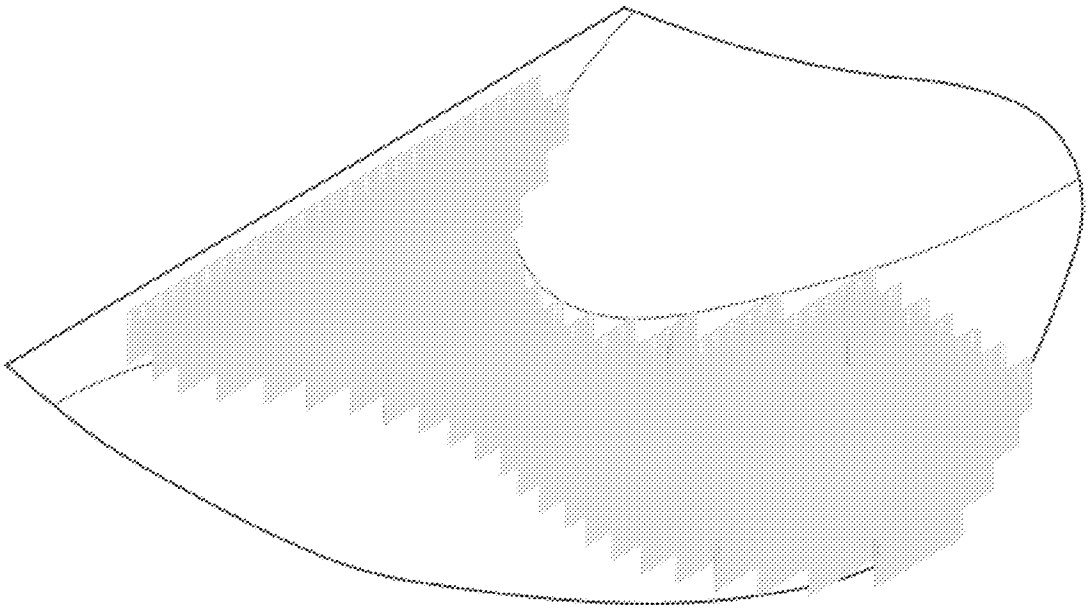
FIG. 8 is a perspective view showing said backing segment after having undergone three tufting passes of the first tufting frame it encounters which tufts that segment.
Figure 9:
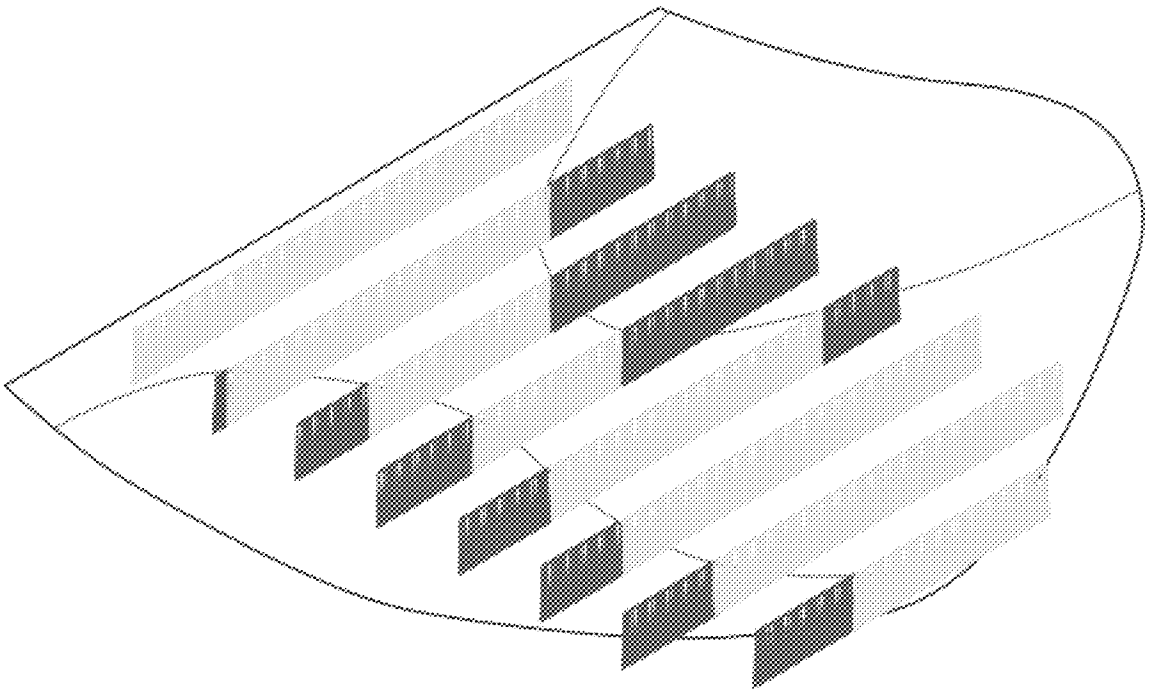
FIG. 9 is a perspective view showing said backing segment after having undergone one tufting pass of the second tufting frame it encounters which tufts that segment.
Figure 10:
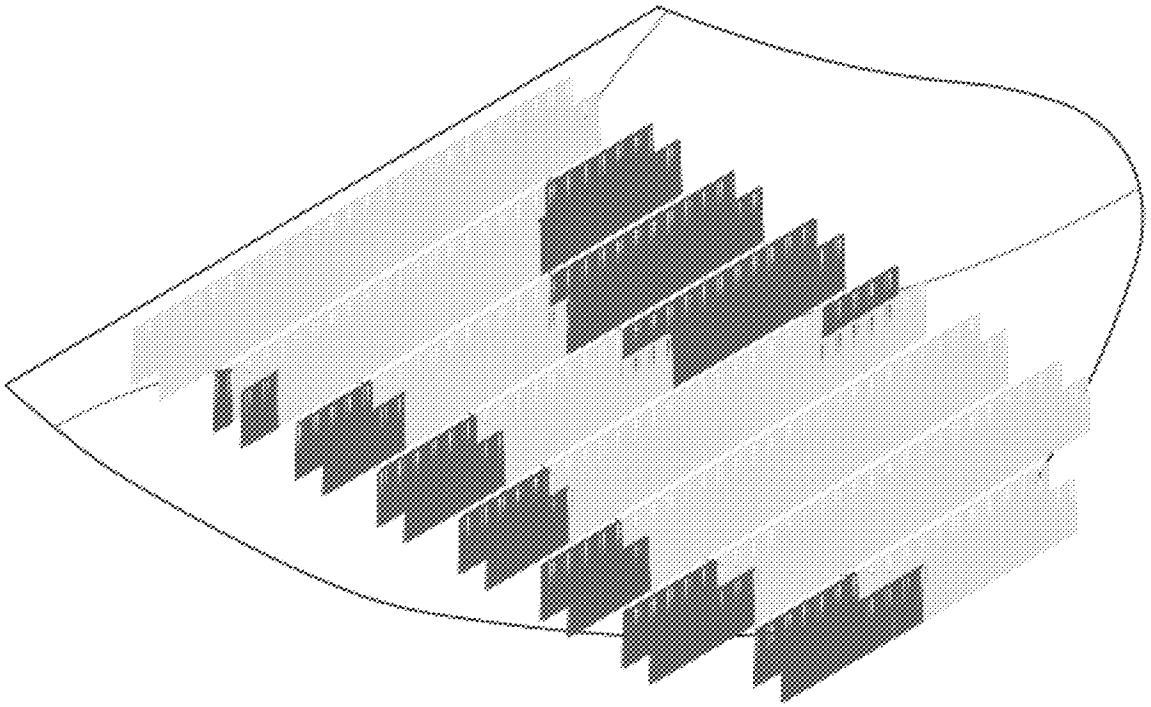
FIG. 10 is a perspective view showing said backing segment after having undergone two tufting passes of the second tufting frame it encounters which tufts that segment.
Figure 11:
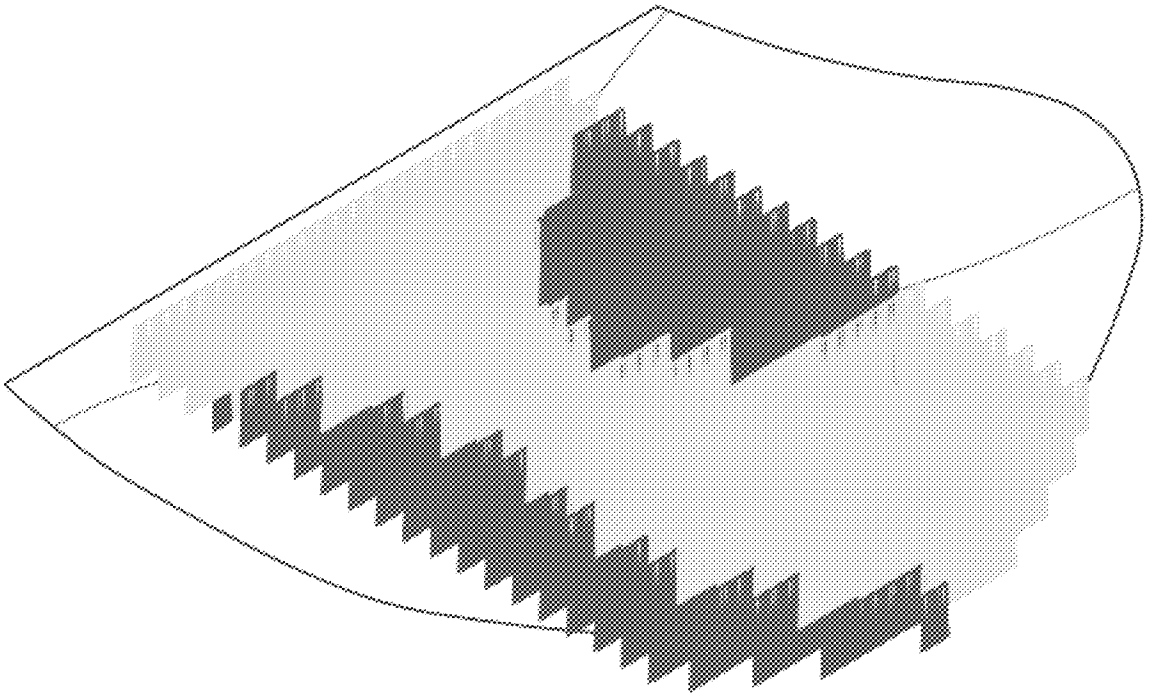
FIG. 11 is a perspective view showing said backing segment after having undergone three tufting passes of the second tufting frame it encounters which tufts that segment.

The bed frame 1 and tenter frame 5 are shown in isolation in FIG. 4, and a more detailed view of the tenter frame is provided in FIG. 5. In the embodiment there depicted, the bed frame 1 is a horizontally oriented, generally rectangular beam structure. The tenter frame 5 is mounted atop the bed frame 1 via attachments near its opposing lateral ends. The tenter frame 5 generally comprises a parallel pair of chains 13 which are each looped around a pair of shaft-driven sprockets 12. Pin pads 11 along the upper reaches of the tenter chains 13 grip an elongate sheet of backing material 4 near its lateral edges and allow the tenter frame 5 to longitudinally advance and retract the backing 4 via chain rotation. This engagement also effectively prevents lateral displacement of the backing 4 as it travels to and fro during the tufting process. Since a typical backing sheet 4 to be tufted by the present apparatus will have a width of fifteen feet, the parallel tenter chains 13 should be approximately that far apart.

Additionally, although not shown in the accompanying drawings, it should be understood that, in an alternative embodiment of the tenter frame 5, the chains can run parallel to each other, in part, and slightly divergent from each other, in another part, in a configuration that is well understood by those skilled in the art. In such an embodiment a configuration, the diverging portions of the tenter frame 5 would be situated just before the apparatus's tufting zone for the purpose of in order to pre-stretch backing material prior to it being tufted.

Referring back to FIG. 1, the bed frame 1 is slidably mounted atop a support assembly 9 such that the bed frame—and, therefore, a backing segment 4 attached to the tenter frame 5—can be moved forward and rearward even without tenter chain rotation. The support assembly 9 can take any number of forms that enable such bed frame movement. For example, the assembly 9 can comprise a series of rollers that are fixed along the bottom of the bed frame and roll within floor-mounted guide tracks. Then, a threaded shaft motor 8 that is fixed to the floor can impart motion to the bed frame 1 according to a tufting operation program stored in the computer. However, it should be understood that a variety of linear motion systems for advancing the bed frame 1 could be substituted for this track and roller assembly.

Within the scope of the invention, the apparatus can include and/or utilize as few as one tufting frame 2 during its operation. Nevertheless, it will optimally utilize at least as many tufting frames as is the number of colors of yarn to be tufted into a backing sheet 4 in executing a single tufting operation program. For example, if a roll of backing is to be tufted into football field turf with green yarn, predominantly, as well as much smaller volumes of white, red and blue yarns, then operational efficiency may dictate dedicating one tufting frame 2 to each of the white, red and blue yarns and at least two tufting frames 2 to the green yarn.

Figure 1:
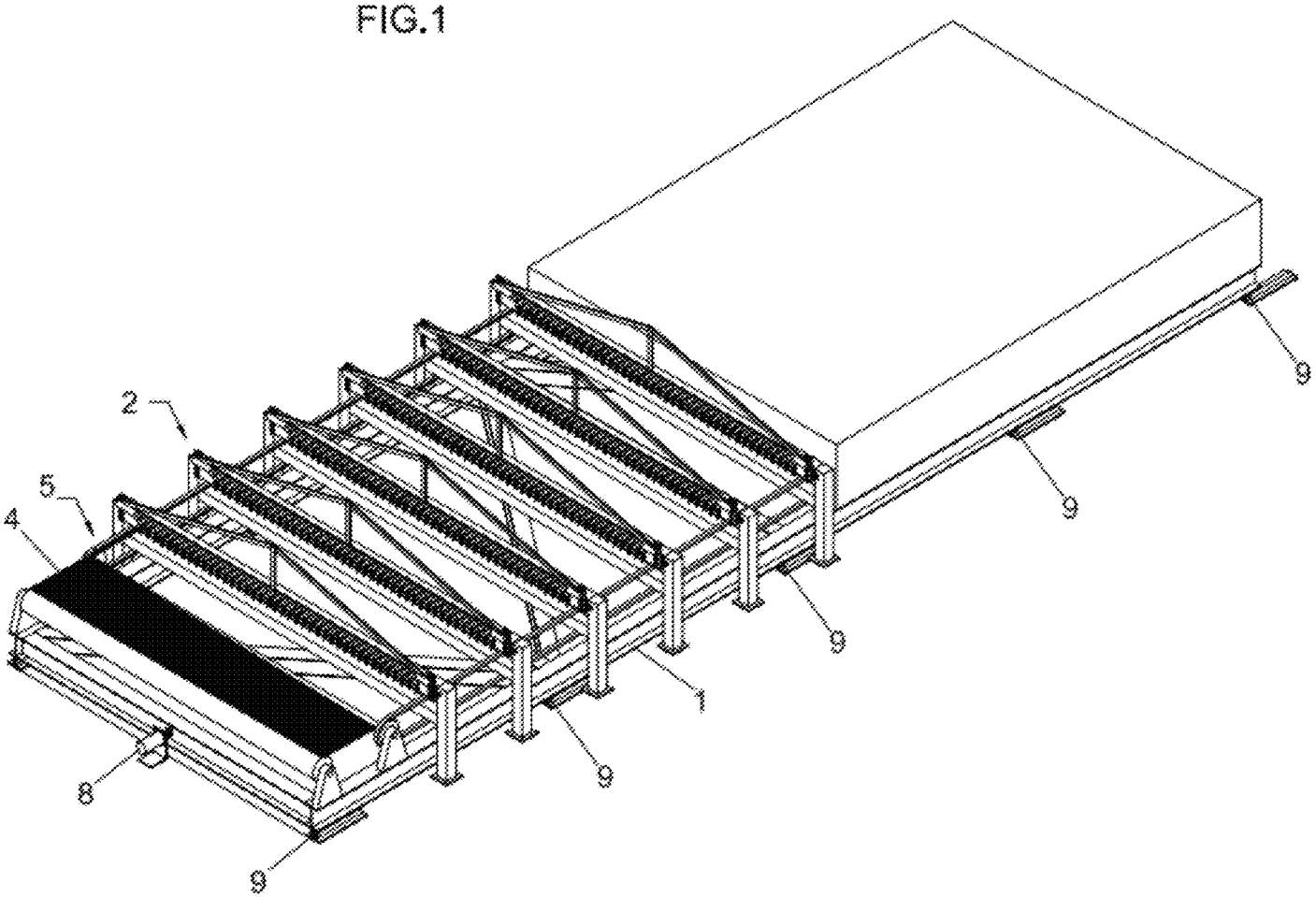
FIG. 1 is a proximal perspective view of an embodiment of the tufting machine of the present invention.
Figure 2:
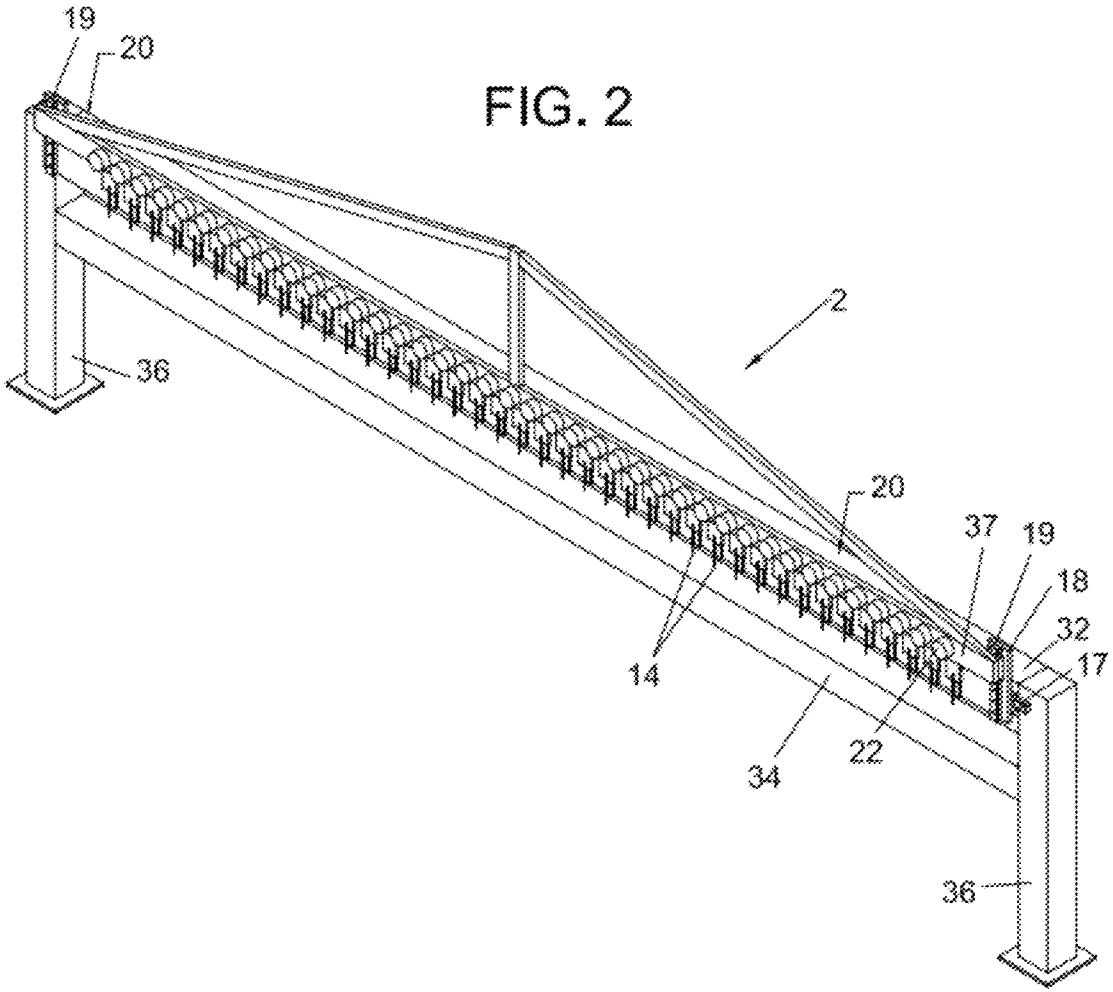
FIG. 2 is a perspective view of a tufting frame element and needle drive beam assembly of said machine.
Figure 3:
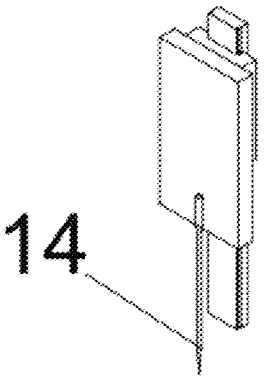
FIG. 3 is a perspective view of an individual needle assembly of said machine.

In any event, a tufting frame 2 is a gantry-like structure defined by dual horizontal beams 32, 34 that traverse above and below the backing 4, respectively, and are elevated from the floor by vertical posts 36 attached at their outer ends. The "tufting head" of the present machine is actually formed by two yarn manipulating carriages which are slidably mounted to the separate tufting frame beams 32, 34. More specifically, and as can be seen in FIG. 2, running along the front face of the upper beam 32 is a rail 17 to which an elongate needle carriage 20 is slidably mounted. Although not illustrated, a similar rail-mounted looper carriage is disposed along the lower beam 34. Computer-controlled drive systems allow these carriages to synchronously travel along the tufting frame 2.

The needle carriage 20 introduces yarns (not shown) into the backing 4. The needle carriage 20 can have virtually any configuration so long as it includes means for reciprocating individual yarn needles and its travel along the upper beam 32 is computer-controlled. Nevertheless, in the embodiment depicted in FIG. 2, the needle carriage 20 includes a parallel pair of vertically disposed base plates 18 to which a needle bar 37 is coupled. In fact, the needle bar 37 is vertically slidable along rails 19 attached to the fronts of the base plates 18, and it is laterally driven along the upper beam 32 of the tufting frame 2 by mechanisms disclosed in U.S. Pat. No. 7,814,850 to the present inventor (the '850 patent). A series of tufting needles 14 are aligned along the needle bar 37 via individual needle drive mechanisms which asynchronously reciprocate the needles 14. The needles 14 can be driven by a variety of means known in the art. While needles 14 insert their yarns into the backing 4 in accordance with a (predefined pattern, corresponding loopers hook those yarns to form loop pile tufts along the downward facing side of the backing 4, Then, to form cut pile, a cutting mechanism of the type also disclosed in the '850 patent is utilized.

To initiate tufting, while all tufting needles 14 remain idle, and while pin pads 11 along the upper reaches of a pair of looped tenter chains 13 are gripping a sheet of backing material 4, the tenter chains 13 are momentarily rotated in order to advance the backing 4 through the tufting zone a distance equal to the centerline-to-centerline distance between the successive tufting frames 2. Simultaneously, the bed frame 1 is retracted along the support assembly 9 to its rearmost position, and the needle carriages 20 are returned to their leftmost and starting positions, as well as to their desired vertical positions (which dictates the height of pile they create).

Then, with the tenter chains 13 not rotating, the bed frame 1 incrementally advances in coordination with the downstroking of selected tufting needles 14 in order to introduce yarn into the backing 4. Needle selection solenoids 22 are energized for each corresponding tufting needle 14 that is positioned over a tuft location where the color of yarn carried by those needles 14 is to be inserted into the backing in accordance with a preconceived graphic design. As the eye of the needle 14 carrying a yarn bundle passes through the backing 4, the yarn bundle is engaged by a looper hook. This tufting process continues until the bed frame 1 has traveled a distance equal to the longitudinal spacing between successive tufting frames 2. The looper hooks are then cleared of yarn loops by activating a cutting element of the type described in the '850 patent.

Next, as the needles 14 are again idle, the bed frame 1 is retracted to its previous starting position, and the needle carriages 20 are shifted laterally a distance of one gauge width so as to position their needles 14 to initiate rows of tufting that are to be laterally adjacent the just completed rows.

The tuft row formation process is then repeated as many times as is necessary for the needle carriages 20 to have shifted the entire distance between the axes of laterally adjacent needles 14. For example, if that spacing is 4.50 inches and the desired tuft gauge is 0.75 inches, then six iterations of tufting will be executed, as described above, in order to create the requisite number of tuft rows. In any event, once the appropriate number of rows are formed, the bed frame 1 is again retracted, the needle carriages 20 returns to its starting position, the tenter chains 13 rotate forward to advance the backing a distance equal to the spacing of the tufting frames 2.

The entire row formation process is then repeated as many as is necessary to tuft the length of the backing 4.

What is claimed is:

1. A tufting machine for tufting yarn into an elongate backing material according to a graphic design, the tufting machine comprising:

at least two separate rows of tufting needles disposed above and arranged transverse to the backing, the needles being configured to asynchronously reciprocate in order to insert yarn into the backing according to the design, and wherein needle rows are longitudinally spaced apart;

at least two separate rows of means for catching yarn disposed below and arranged transverse to the backing, the yarn catching means being configured to engage yarn inserted through the backing by reciprocating tufting needles and thereby form pile along the backing;

a support assembly mounted to the floor;

a bed frame mounted atop the support assembly, wherein the bed frame is configured to travel along the support assembly longitudinally relative to the needle rows;

a tenter frame mounted to the bed frame and configured to engage the backing, move it longitudinally relative to the bed frame, and inhibit it from moving laterally; and wherein the tenter frame travels longitudinally, in a non-rotational manner, relative to the needle rows by virtue of bed frame travel along the support assembly.

2. The tufting machine of claim 1, wherein said support assembly comprises a guide track and roller assembly.

3. The tufting machine of claim 1, further comprising:

a bed frame drive mechanism configured to cause said bed frame to travel longitudinally along said support assembly;

needle drive mechanisms configured to reciprocate said needles individually;

a tenter drive mechanism configured to move the backing relative to the bed frame; and a computer on which the graphic design is stored, wherein the computer controls the various drive mechanisms in order that said needles tuft yarn into the backing according to the graphic design.

4. The tufting machine of claim 1, further comprising at least one tufting frame defined by having upper and lower beams that traverse above and below the backing, respectively, wherein tufting needles are attached to the upper beam, and yarn catching means are attached to the lower beam.

5. The tufting machine of claim 4, wherein each said tufting frame further comprises a needle carriage that is laterally movable along its upper beam, and wherein the tufting needles attached to each tufting frame are reciprocably mounted to a needle carriage.

6. The tufting machine of claim 1, wherein said tenter frame comprises:

a pair of looped and laterally spaced chains having upper reaches positioned to engage the backing;

means for gripping the backing disposed along the chains and configured to engage the backing and keep it laterally stable; and a drive sprocket for imparting rotational movement of the chains and thereby conveying the engaged backing relative to said bed frame.

7. The tufting machine of claim 6, wherein said chains are defined by having portions that are divergent from each other and other portions that are parallel to each other, wherein their divergent portions laterally stretch the backing.

8. The tufting machine of claim 1, further comprising backing guide rollers disposed toward the opposing longitudinal ends of said bed frame.

9. The tufting machine of claim 1, further comprising a spooling roller configured to wind up the backing after it moves longitudinally beyond said bed frame.

10. A tufting machine for tufting yarn into an elongate backing material according to a graphic design, the tufting machine comprising:

at least two separate rows of tufting needles disposed above and arranged transverse to the backing, the needles being configured to asynchronously reciprocate in order to insert yarn into the backing according to the design, and wherein needle rows are longitudinally spaced apart;

at least two separate rows of means for catching yarn means disposed below and arranged transverse to the backing, the yarn catching means being configured to engage yarn inserted through the backing by reciprocating tufting needles and thereby form pile along the backing;

comprising means for cutting yarn disposed below and arranged transverse to the backing, the yarn cutting means for severing loop pile formed by the yarn catching means and thereby rendering cut pile;

a support assembly mounted to the floor;

a bed frame mounted atop the support assembly, wherein the bed frame is configured to travel along the support assembly longitudinally relative to the needle rows;

a tenter assembly mounted to the bed frame and configured to engage the backing, move it longitudinally relative to the bed frame, and inhibit it from moving laterally; and wherein the tenter frame travels longitudinally, in a non-rotational manner, relative to the needle rows by virtue of bed frame travel along the support assembly.

* * * * *